US007748994B1

(12) United States Patent
Peng et al.

(10) Patent No.: US 7,748,994 B1
(45) Date of Patent: Jul. 6, 2010

(54) BOARD-TO-BOARD CONNECTOR ASSEMBLY

(75) Inventors: Yung-Chi Peng, Tu-Cheng (TW); Sheng-Nan Yu, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/464,869

(22) Filed: May 13, 2009

(51) Int. Cl.
*H01R 12/00* (2006.01)

(52) U.S. Cl. ..... 439/74; 439/660

(58) Field of Classification Search ..... 439/70, 439/71, 74, 81, 83, 346, 374, 566, 570, 660, 439/939

See application file for complete search history.

(56) References Cited

U.S. PATENT DOCUMENTS 4,955,820 A * 9/1990 Yamada et al. ..... 439/83
5,057,027 A * 10/1991 Yamada et al. ..... 439/83
7,112,091 B2 * 9/2006 Okura et al. ..... 439/570
7,247,029 B2 * 7/2007 Chen ..... 439/66
7,278,861 B2 * 10/2007 Kishi et al. ..... 439/74
7,320,605 B2 * 1/2008 Chang et al. ..... 439/74
7,588,443 B2 * 9/2009 Wu et al. ..... 439/74

* cited by examiner

*Primary Examiner*—Thanh-Tam T Le

(57) ABSTRACT

A board-to-board connector assembly includes a receptacle connector and a plug connector. The receptacle connector includes a receptacle housing, a plurality of first terminals and at least one fixing member disposed in the receptacle housing respectively. Each of the first terminals has a crooked first resilient portion and a soldering portion protruded from a free end of the first resilient portion to further project under the receptacle housing. The fixing member has a pair of crooked second resilient portions and two soldering tails each protruded from a free end of the respective second resilient portion to further project under the receptacle housing. The plug connector includes a plug housing mated with the receptacle housing, and a plurality of second terminals disposed in the plug housing and electrically contacting the corresponding first terminals.

8 Claims, 5 Drawing Sheets

BOARD-TO-BOARD CONNECTOR ASSEMBLY

BACKGROUND OF THE INVENTION

1. Field of the Invention

The present invention generally relates to an electrical connector, and more particularly to a board-to-board connector assembly.

2. The Related Art

Generally, a board-to-board connector assembly includes a receptacle connector and a plug connector mounted to a pair of spaced parallel printed circuit boards for electrically interconnecting the printed circuit boards. The receptacle connector includes a plurality of first terminals for being soldered to one printed circuit board. The plug connector includes a plurality of second terminals for being soldered to the other printed circuit board. When the plug connector is mated with the receptacle connector, the first terminal electrically contact the corresponding second terminal so as to form an electrical connection between the printed circuit boards. However, with the development of electronic field, the board-to-board connector assembly is microminiaturized more and more so that the distance between the printed circuit boards may be longer or shorter than a standard distance due to the manufacturing or assembly inaccuracy. As a result, that leads the plug connector to be improperly engaged with the receptacle connector and further results in an unsteady contact between the first terminal and the corresponding second terminal so that affects the electrical connection between the printed circuit boards. Therefore, a board-to-board connector assembly capable of adapting to the distance adjustment between the printed circuit boards is required.

SUMMARY OF THE INVENTION

An object of the present invention is to provide a board-to-board connector assembly adapted for electrically interconnecting female and male printed circuit boards. The board-to-board connector assembly includes a receptacle connector and a plug connector. The receptacle connector includes a receptacle housing, a plurality of first terminals disposed in the receptacle housing, and at least one fixing member. The receptacle housing defines a receiving recess at a top thereof and four sidewalls are formed around the receiving recess. Each of the first terminals has a base portion, a connecting arm extending upward from one end of the base portion, and a first resilient portion crookedly extending downward from a top end of the connecting arm. A free end of the first resilient portion protrudes downward to form a soldering portion beyond a bottom of the base portion. The soldering portion projects under the receptacle housing for being soldered to the female printed circuit board. The fixing member is disposed in the sidewall and has a base frame and a pair of second resilient portions crookedly extending from two opposite ends of the base frame. A free end of each of the second resilient portions protrudes to form a soldering tail projecting under the sidewall for being soldered to the female printed circuit board. The plug connector includes a plug housing received in the receiving recess of the receptacle housing, and a plurality of second terminals disposed in the plug housing and soldered to the male printed circuit board. The second terminals electrically contact the corresponding first terminals when the plug connector is mated with the receptacle connector.

As described above, the board-to-board connector assembly of the present invention utilizes the first resilient portion of the first terminal and the second resilient portion of the fixing member to adapt to the distance adjustment between the two printed circuit boards so as to ensure a steady contact between the first terminal and the corresponding second terminal. Therefore, a steady electrical connection can be achieved between the printed circuit boards.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
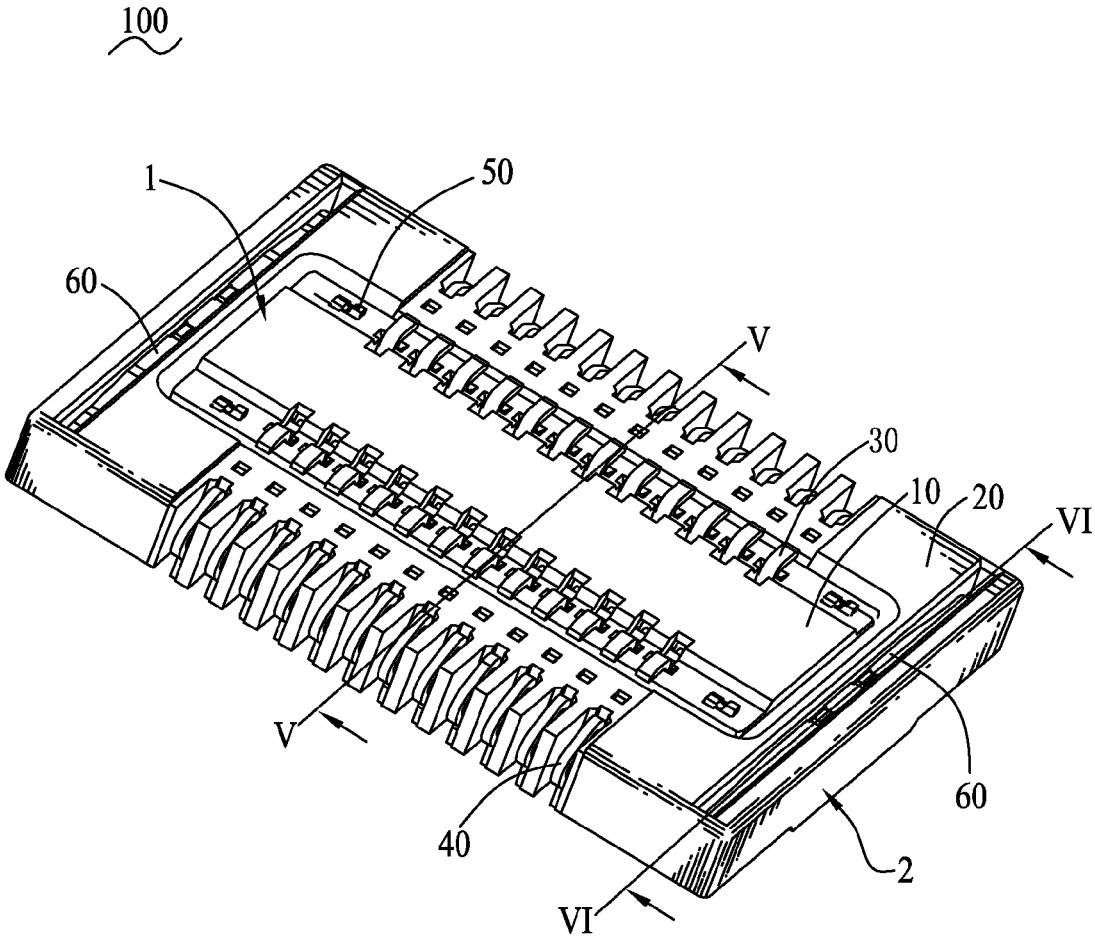
FIG. 1 is a perspective view of a board-to-board connector assembly in accordance with the present invention.
Figure 2:
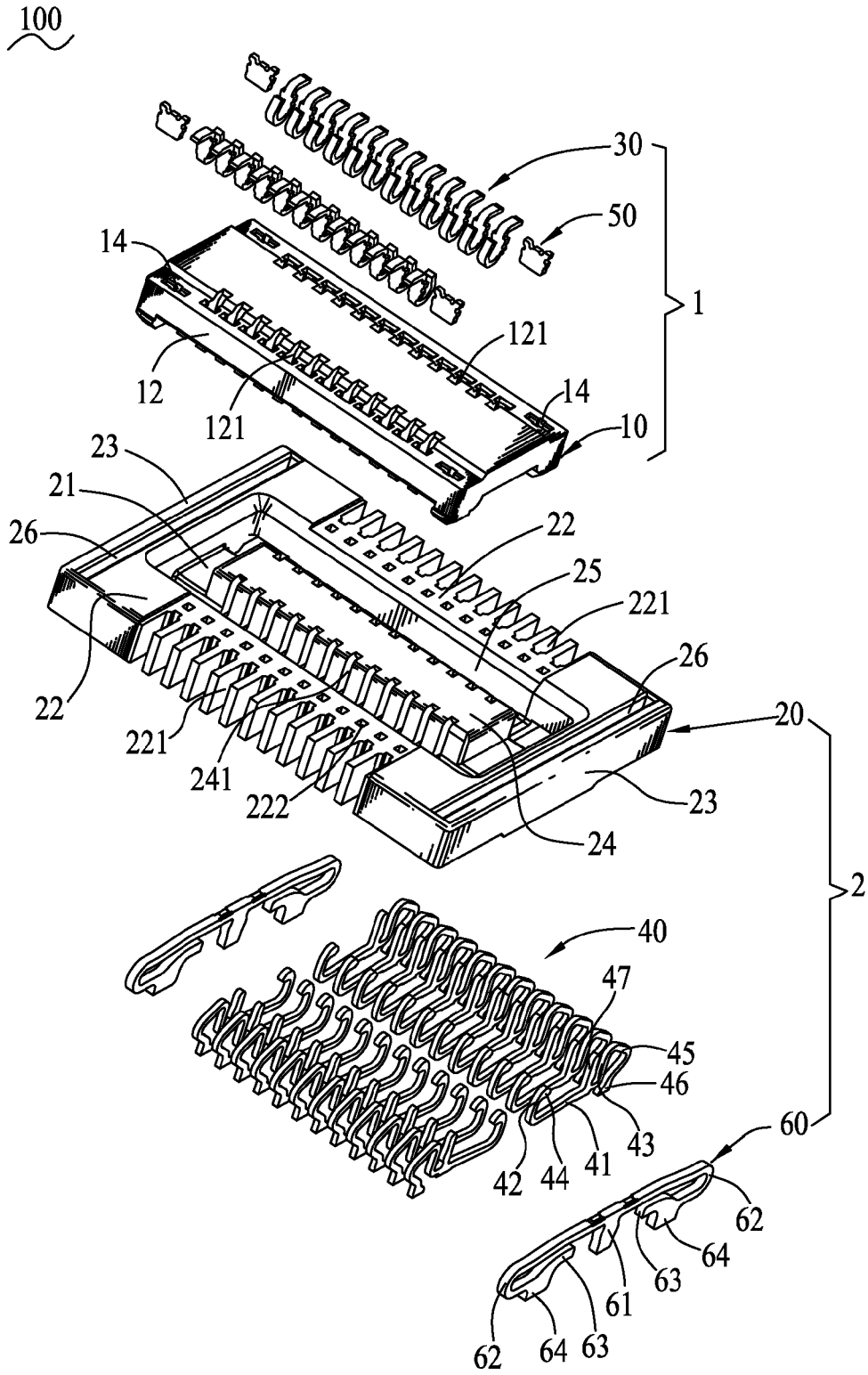
FIG. 2 is an exploded perspective view of the board-to-board connector assembly of FIG. 1.

With reference to FIG. 1 and FIG. 2, a board-to-board connector assembly 100 in accordance with the present invention includes a receptacle connector 2 and a plug connector 1 which can be mounted to a pair of spaced parallel female and male printed circuit boards (not shown) to electrically interconnect the printed circuit boards, wherein the plug connector 1 is mated with the receptacle connector 2. The receptacle connector 2 includes a receptacle housing 20, a plurality of first terminals 40 and a pair of fixing members 60 disposed in the receptacle housing 20 respectively.

Figure 4:
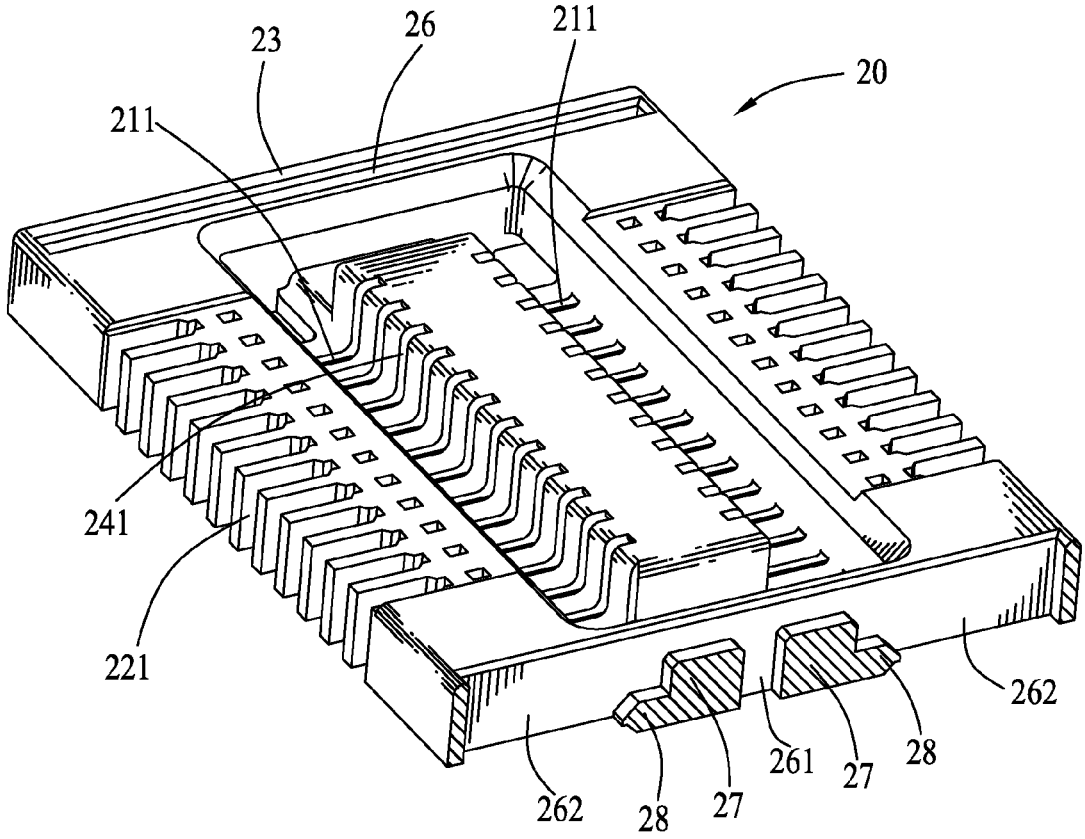
FIG. 4 is a cutaway perspective view of a receptacle housing of a receptacle connector of the board-to-board connector assembly of FIG. 1.

Referring to FIGS. 2 and 4, the receptacle housing 20 has a rectangular flat base board 21. Two opposite sides of the base board 21 extend upward to form a pair of first sidewalls 22 extending longwise. Two opposite ends of the base board 21 extend upward to form a pair of second sidewalls 23. A middle of the base board 21 protrudes upward to form a rectangular inserting rib 24 extending longwise and having two opposite ends apart from the corresponding second sidewalls 23. Accordingly, a ringlike receiving recess 25 is formed among the base board 21, the first sidewalls 22, the second sidewalls 23 and the inserting rib 24. Two opposite sides of the inserting rib 24 define a plurality of receiving fillisters 241 arranged at regular intervals along a longwise direction thereof and communicating with the receiving recess 25. The outside of each of the first sidewalls 22 defines a plurality of receiving grooves 221 corresponding to the receiving fillisters 241 one-on-one and each vertically extending to penetrate through the first sidewall 22. Each of the receiving fillisters 241 is connected with the respective receiving groove 221 by means of a receiving channel 211 in the base board 21. Each of the first sidewalls 22 further defines a plurality of fixing apertures 222 each vertically penetrating therethrough and connected with the respective receiving channel 211. Each of the second sidewalls 23 defines a substantially m-shaped receiving passageway 26 extending longitudinally. The receiving passageway 26 includes a pair of receiving slots 262 vertically penetrating the second sidewall 23 at two ends thereof and a fastening slot 261 connected between the receiving slots 262.

Accordingly, a pair of clipping portions 27 is formed between the fastening slot 261 and the corresponding receiving slots 262. The clipping portions 27 oppositely protrude into the corresponding receiving slots 262 to form two restricting blocks 28 at a bottom thereof.

Figure 5:
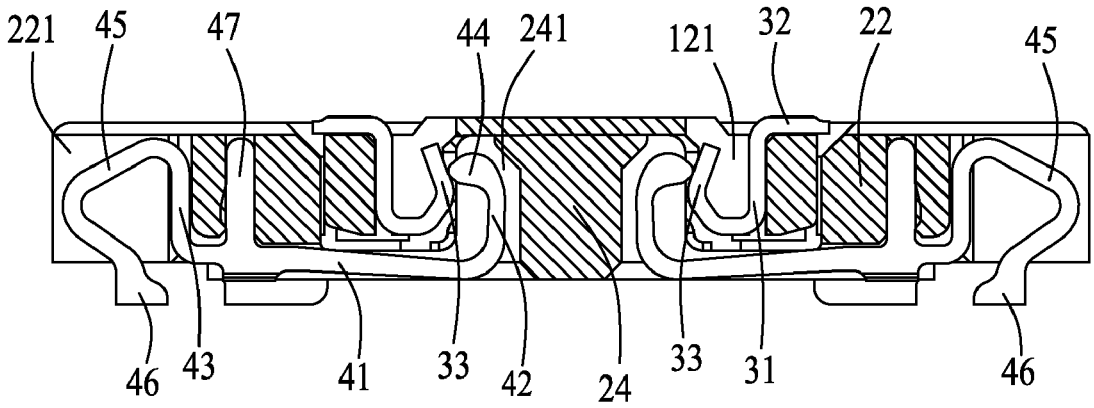
FIG. 5 is a cross-sectional view of the board-to-board connector assembly along line V-V of FIG. 1.

Referring to FIG. 2 and FIG. 5, each of the first terminals 40 has a bar-shaped base portion 41. Two opposite ends of the base portion 41 extend upward to form an elastic arm 42 and a connecting arm 43 respectively. A free end of the elastic arm 42 protrudes towards the connecting arm 43 to form a contact portion 44. A lying V-shaped first resilient portion 45 extends from a free end of the connecting arm 43 and has a mouth facing the connecting arm 43 and indirectly the elastic arm 42. A free end of the first resilient portion 45 protrudes downward to form a soldering portion 46 beyond a bottom of the base portion 41. The base portion 41 further protrudes upward to form a fixing arm 47 adjacent to the connecting arm 43.

Figure 6:
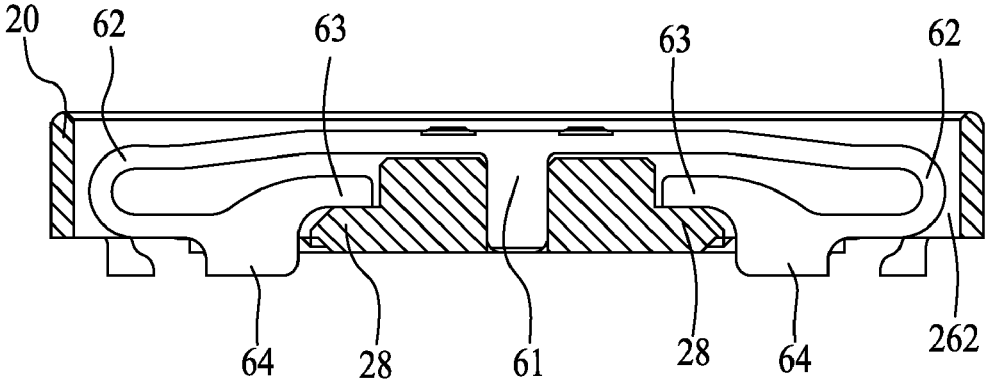
FIG. 6 is another cross-sectional view of the board-to-board connector assembly along line VI-VI of FIG. 1.

Referring to FIG. 2 and FIG. 6, each of the fixing members 60 has a T-shaped base frame 61. A pair of lying U-shaped second resilient portions 62 extends oppositely from two free wings of the base frame 61, and two mouths thereof face a vertical portion of the base frame 61. A free end of each of the second resilient portions 62 protrudes downward to form a soldering tail 64, and protrudes upward and further extends towards the vertical portion of the base frame 61 to form a restricting portion 63.

Referring to FIGS. 5 and 6 again, when the receptacle connector 2 is assembled, the base portion 41 of each of the first terminals 40 is received in the corresponding receiving channel 211 of the receptacle housing 20 and the fixing arm 47 is inserted in the corresponding fixing aperture 222. The elastic arm 42 is received in the corresponding receiving fillister 241 and the contact portion 44 stretches into the receiving recess 25. The connecting arm 43 and the first resilient portion 45 are received in the corresponding receiving groove 221. The soldering portion 46 projects under the first sidewall 22 for being soldered to the female printed circuit board. Each of the fixing members 60 is disposed in the receiving passageway 26 of the respective second sidewall 23. The vertical portion of the base frame 61 is inserted in the fastening slot 261, and the second resilient portions 62 are received in the corresponding receiving slots 262. The restricting portion 63 is disposed against the corresponding restricting block 28 so as to be restricted with each other. The soldering tail 64 is projected under the second sidewall 23 for being soldered to the female printed circuit board. So the receptacle connector 2 can slightly move far away from or approach the female printed circuit board due to the elasticity of the first resilient portion 45 of the first terminal 40 and the second resilient portion 62 of the fixing member 60.

Figure 3:
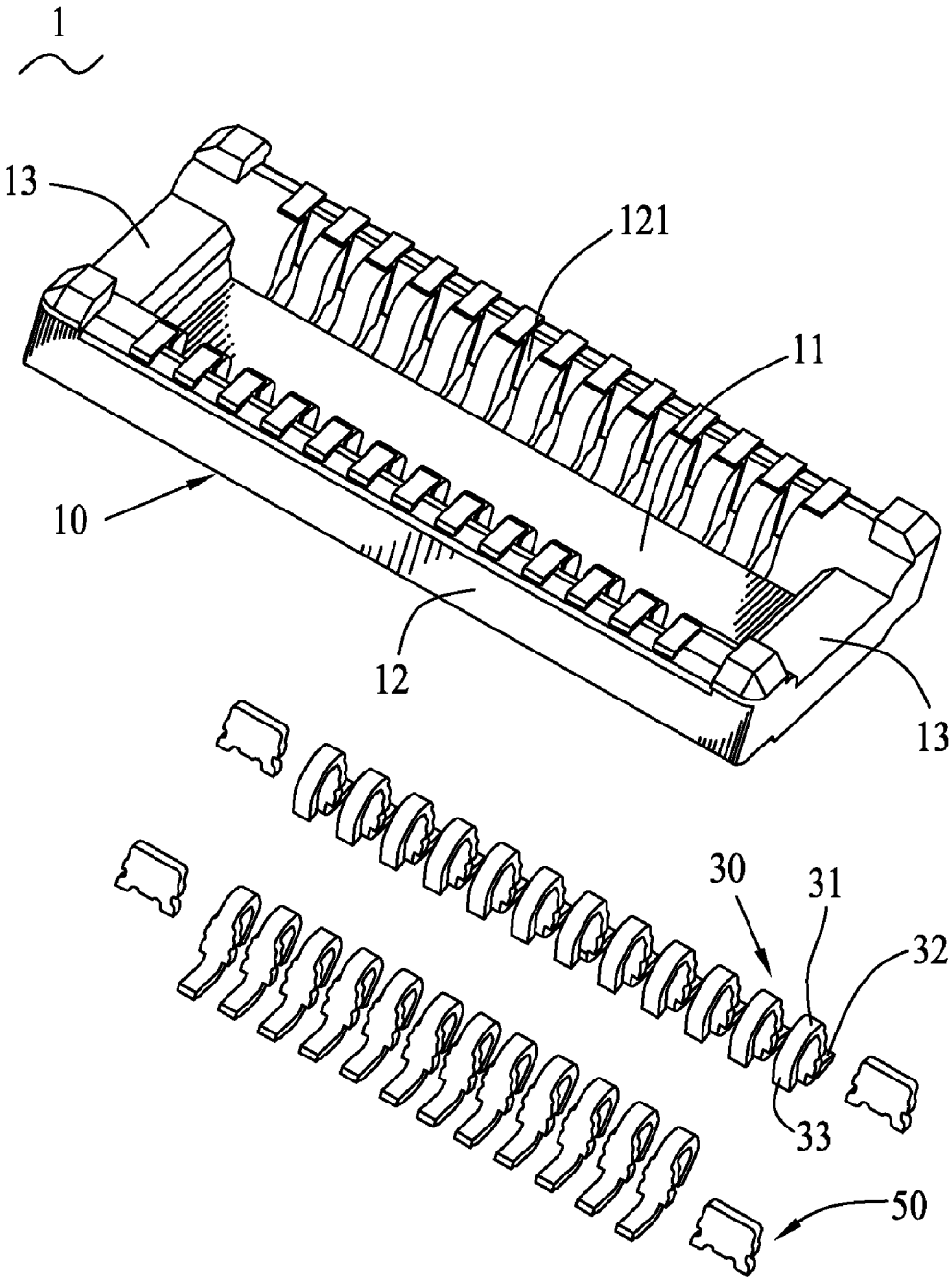
FIG. 3 is an exploded perspective view of a plug connector of the board-to-board connector assembly of FIG. 1.

Referring to FIG. 2 and FIG. 3, the plug connector 1 includes a plug housing 10 mated with the receptacle housing 20, a plurality of second terminals 30 and four fixing slices 50 disposed in the plug housing 10 respectively.

The plug housing 10 is of rectangular configuration and has a rectangular receiving chamber 11 passing through a mating surface thereof and mated with the inserting rib 24 of the receptacle housing 20. Accordingly, a pair of third sidewalls 12 each extending longwise and a pair of end-walls 13 are formed around the receiving chamber 11. The inside of each of the third sidewalls 12 defines a plurality of receiving cavities 121 arranged at regular intervals along a longwise direction thereof and communicating with the receiving chamber 11. Each of the receiving cavities 121 extends vertically to penetrate through the respective third sidewall 12. The plug housing 10 further defines four locking slots 14 respectively located at four corners thereof.

Referring to FIG. 3 and FIG. 5, each of the second terminals 30 has a substantially L-shaped base arm 31. A free end of the base arm 31 extends to form a soldering arm 32, and the other free end of the base arm 31 extends to form a contact arm 33 facing the base arm 31 and arched far away from the soldering arm 32.

Referring to FIG. 5 again, when the plug connector 1 is assembled, the base arm 31 of each of the second terminals 30 is received in the corresponding receiving cavity 121 of the plug housing 10, and the contact arm 33 stretches into the receiving chamber 11. The soldering arm 32 is disposed on a top surface of the plug housing 10 for being soldered to the male printed circuit board. The fixing slices 50 are fastened in the respective locking slots 14 and can be soldered with the male printed circuit board in order to fix the plug connector 1 on the male printed circuit board firmly.

Referring to FIG. 1 and FIG. 5, when the plug connector 1 is engaged with the receptacle connector 2, the third sidewalls 12 and the end-walls 13 of the plug housing 10 are inserted in the receiving recess 25 of the receptacle housing 20, and the inserting rib 24 is inserted in the receiving chamber 11. The contact portion 44 of the first terminal 40 electrically contacts the contact arm 33 of the corresponding second terminal 30 so that an electrical connection can be formed between the printed circuit boards.

In use, when there is a relatively longer/shorter distance than a standard distance between the printed circuit boards, the board-to-board connector assembly 100 can automatically adapt to the distance adjustment on account of the elasticity of the first resilient portion 45 of the first terminal 40 and the second resilient portion 62 of the fixing member 60 so as to ensure a firm engagement between the plug connector 1 and the receptacle connector 2 and further ensure a steady contact between the first terminals 40 and the corresponding second terminals 30 for achieving a steady electrical connection between the printed circuit boards. When the plug connector 1 is withdrawn from the receptacle connector 2, the restricting block 28 of the receptacle housing 20 will be restricted by the corresponding restricting portion 63 of the fixing member 60 so as to prevent the receptacle connector 2 from moving along with the unplugging plug connector 1.

As described above, the board-to-board connector assembly 100 of the present invention utilizes the resilient portions 45, 62 to adapt to the distance adjustment between the two printed circuit boards so as to ensure a steady contact between the first terminal 40 and the corresponding second terminal 30. Therefore, a steady electrical connection can be achieved between the printed circuit boards.

What is claimed is:

1. A board-to-board connector assembly adapted for electrically interconnecting female and male printed circuit boards, comprising:

a receptacle connector having a receptacle housing defining a receiving recess at a top thereof and four sidewalls formed around the receiving recess, a plurality of first terminals disposed in the receptacle housing, each of the first terminals having a base portion, a connecting arm extending upward from one end of the base portion, and a first resilient portion crookedly extending downward from a top end of the connecting arm, a free end of the first resilient portion protruding downward to form a soldering portion beyond a bottom of the base portion, the soldering portion projecting under the receptacle housing for being soldered to the female printed circuit board, and at least one fixing member disposed in the sidewall, the fixing member having a base frame and a pair of second resilient portions crookedly extending from two opposite ends of the base frame, a free end of each of the second resilient portions protruding to form a soldering tail projecting under the sidewall for being soldered to the female printed circuit board; and a plug connector having a plug housing received in the receiving recess of the receptacle housing, and a plurality of second terminals disposed in the plug housing and soldered to the male printed circuit board, the second terminals electrically contacting the corresponding first terminals when the plug connector is mated with the receptacle connector.

2. The board-to-board connector assembly as claimed in claim 1, wherein the first resilient portion is a lying V-shape and has a mouth facing the connecting arm.

3. The board-to-board connector assembly as claimed in claim 1, wherein each of the first terminals further has an elastic arm extending upward from the other end of the base portion and a contact portion protruded from a free end of the elastic arm, the contact portion stretches into the receiving recess to electrically contact the respective second terminal.

4. The board-to-board connector assembly as claimed in claim 3, wherein the base portion further extends upward to form a fixing arm adjacent to the connecting arm and fastened in the sidewall.

5. The board-to-board connector assembly as claimed in claim 1, wherein an outside of each of two facing sidewalls without the fixing member disposed therein defines a plurality of receiving grooves each vertically extending to penetrate through the sidewall, the connecting arm and the first resilient portion of the first terminal are received in the receiving groove and the soldering portion projects out of the receiving groove.

6. The board-to-board connector assembly as claimed in claim 1, wherein each of the second resilient portions of the fixing member is a substantially lying U-shape facing the other, the sidewall with the fixing member disposed therein defines two receiving slots each vertically penetrating therethrough, the second resilient portions are respectively received in the corresponding receiving slots and the soldering tails project out of the respective receiving slots.

7. The board-to-board connector assembly as claimed in claim 6, wherein two restricting blocks each are formed in the respective receiving slots, two free ends of the two second resilient portions extend face-to-face to form a pair of restricting portions disposed against the respective restricting blocks so as to be restricted with each other.

8. The board-to-board connector assembly as claimed in claim 6, wherein a fastening slot is further formed between the receiving slots and connected with the receiving slots at a top thereof, the base frame has a vertical portion between the second resilient portions to be inserted in the fastening slot.

* * * * *